US006217407B1

(12) United States Patent
Laursen

(10) Patent No.: US 6,217,407 B1
(45) Date of Patent: Apr. 17, 2001

(54) METHOD OF PRODUCING A HAIRPIECE WHICH CAN BE FASTENED ON A TOY FIGURE, AND TOY FIGURE WITH A HAIRPIECE FASTENED THEREON

(75) Inventor: Palle W. Laursen, Billund (DK)

(73) Assignee: INTERLEGO AB, Baar (CH)

( * ) Notice: Subject to any disclaimer, the term of this patent is extended or adjusted under 35 U.S.C. 154(b) by 0 days.

(21) Appl. No.: 09/180,666

(22) PCT Filed: May 20, 1997

(86) PCT No.: PCT/EP97/02770

§ 371 Date: Nov. 12, 1998

§ 102(e) Date: Nov. 12, 1998

(87) PCT Pub. No.: WO97/45182

PCT Pub. Date: Dec. 4, 1997

(30) Foreign Application Priority Data

May 24, 1996 (CH) ..... 1311/96

(51) Int. Cl.[7] ..... A63H 3/44
(52) U.S. Cl. ..... 446/394
(58) Field of Search ..... 446/394, 391, 446/390, 372, 369; 132/56, 53, 54

(56) References Cited

U.S. PATENT DOCUMENTS

| | | | | |
|---|---|---|---|---|
| 1,329,509 | * | 2/1920 | Dane et al. . | |
| 1,583,408 | * | 5/1926 | Mackay . | |
| 2,253,635 | * | 8/1941 | Mann . | |
| 2,636,318 | * | 4/1953 | Lock . | |
| 3,199,516 | * | 8/1965 | Frishman . | |
| 3,421,521 | * | 1/1969 | Rich . | |
| 3,448,540 | * | 6/1969 | Ryan et al. . | |
| 3,903,640 | * | 9/1975 | Dunn . | |
| 4,070,790 | * | 1/1978 | Strongin et al. . | |
| 4,964,428 | * | 10/1990 | Lamatrice | 132/216 |
| 5,413,124 | * | 5/1995 | Incando | 132/201 |
| 5,957,139 | * | 9/1999 | Bolli . | |

FOREIGN PATENT DOCUMENTS

| | | | |
|---|---|---|---|
| 326068 | | 11/1975 | (AT) . |
| 1038964 | | 9/1958 | (DE) . |
| 2039707 | | 3/1971 | (DE) . |
| 2831980 | * | 1/1980 | (DE) . |
| 292907 | * | 11/1988 | (EP) . |
| 1146400 | | 11/1957 | (FR) . |
| 2249688 | | 5/1975 | (FR) . |
| 693602 | * | 8/1965 | (IT) . |
| 9615839 | | 5/1996 | (WO) . |
| PCT/EP95/04569 | * | 5/1996 | (WO) . |

* cited by examiner

*Primary Examiner*—D. Neal Muir
(74) *Attorney, Agent, or Firm*—Pitney, Hardin, Kipp & Szuch LLP

(57) ABSTRACT

Hair strands or hair tufts (7) are stitched in loop form on a flat, flexible base (2), for example a textile base, in a region bounded by a desired hairpiece contour (1). The stitched region is then removed from the base (2), by being cut out or stamped out, along the periphery (4) of a border (3) which encloses the hairpiece contour (1). Finally, the resulting flexible hairpiece is slipped over onto part of a toy figure, and possibly adhesively bonded thereon, and the hair strands or hair tufts are cut to length and combed. The method makes it possible, in a simple and cost-effective manner, to provide toy figures of any size, even those made of a hard material, with hairpieces of any appearance.

7 Claims, 2 Drawing Sheets

METHOD OF PRODUCING A HAIRPIECE WHICH CAN BE FASTENED ON A TOY FIGURE, AND TOY FIGURE WITH A HAIRPIECE FASTENED THEREON

It is known to provide a doll's head with hair by sewing hair tufts into the head of the doll. For this purpose, the material of the doll's head has to be comparatively soft in order to be able to be pierced by the needle. These soft materials have the disadvantage that the holes pierced by the needle can be easily torn, with the result that the sewn-in hair tufts are poorly anchored. In addition, the surface of such a material does not lend itself at all well to being painted or printed on, and any painting or printing does not last very long. The disadvantages are the same in the case of other toy figures which are to be provided with hair, for example in the case of a toy horse which is to be provided with a mane or a tail.

The above-mentioned disadvantages of a toy figure, in particular of a doll's head, which is made of a soft plastic material and is to be provided with hair may be avoided by a hairpiece being slipped over onto the body part of the toy figure which is made of any other material, or onto such a doll's head, and possibly adhesively bonded thereon.

Such a wig of hair and its manufacture are described in FR-A-1,146,400. In one embodiment, a fabric of weft and warp threads is formed. The warp threads run only in the center of the fabric and only a few warp threads at the two edges. The central part of such a piece of fabric is glued onto a doll's head along its longitudinal central line, and the region of the warp threads is subsequently trimmed at the edges. Since the weft threads are all oriented in the same direction, this wig does not, however, have very natural appearance.

Another method of producing a hairpiece is described in AT-A-326 068. A contour of the hairpiece to be manufactured is marked on a flat face of a rubber block. Individual hairs or bundles of individual hairs are then held with one hand and their ends pushed into the block by means of a reciprocating blunt needle. The block is put into the bin in which the hairs are embedded in a hardenable material. After hardening the rubber block is pulled off and the hair ends protruding from the hardened material are embedded in a silicone rubber layer. After hardening of the silicone rubber the hardened material is dissolved. The hairpiece is then removed from the remainder of the rubber layer along the hairpiece contour.

The object of the present invention is thus to provide a method which is simple and cost-effective and provides a thickly covered, natural-looking hairpiece for a toy figure of any size, that is to say for small toy figures in particular.

In order to achieve this object, the method according to the invention has the features outlined in Patent claim 1.

By carrying out a stitching operation on a flat, flexible base, a hairpiece of any appearance and of any size and shape can be produced mechanically in a simple manner. This hairpiece may then be fastened without difficulty on the toy-figure body part made of a user-friendly and environmentally acceptable material, in particular on the doll's head.

An exemplary embodiment of the method according to the invention and of the toy figure are described hereinbelow, by way of a doll's head, with reference to the drawings. It goes without saying that the same method steps may also be used for producing a hairpiece for other toy figures, and of course the hairpiece contour mentioned hereinbelow has to be adapted to the respective body part of the toy figure. In the drawings.

Figure 1:
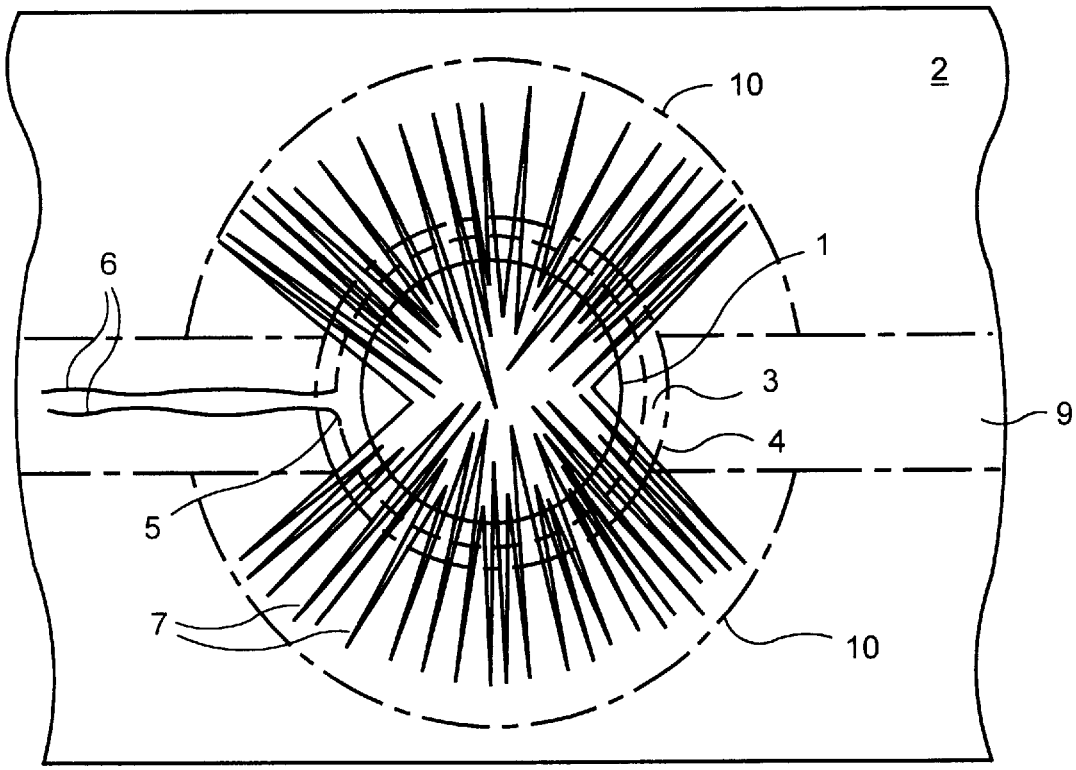
FIG. 1 shows a view of a hairpiece stitched on a base.

In the case of the method of the invention, according to FIG. 1, the contour 1 of the hairpiece which is to be made and fastened on a doll's head is established. The contour 1 depends, of course, on the shape and size of the doll's head which is to be provided with the hairpiece. In the example illustrated, the contour is of a round shape. It is possible to mark the established contour 1 on a partially illustrated, flat base 2 by stitching it flatly onto the base 2. The base 2 should be flexible and may be of a textile nature, in particular woven or knitted. However, it is also possible to use a base of a fibre structure, e.g. a nonwoven fabric, or a plastic base. The base 2 should have elasticity of elongation in at least one direction, preferably in all directions. Alternatively, it is also possible to use a base 2 which is plastically deformable under the action of heat, e.g. a fabric made of polyethylene terephthalate or of polyamide.

The contour 1 is enclosed by an annular border 3, of which the periphery 4 may likewise be marked by stitching. In particular in the case of thermally deformable materials for the base 2, it is possible to stitch around said periphery in the manner of a buttonhole, for example, which is illustrated by chain-dotted lines in FIG. 1. As in the case of a buttonhole, the stitched-round border 3 may be partially cut open. This may advantageously be carried out by the stitching machine itself, since well-equipped stitching machines have piercing devices which make it possible to pierce the periphery 4 partially, that is to say in a grid-like manner. The advantage of this embodiment of the periphery 4 is that the subsequent operation of cutting the stitched hairpiece out of the base 2 is made easier. The only partial piercing of the periphery 4 means that it is not possible for the base 2 to stretch during the operation of stitching the hairpiece strands or hair tufts, this operation being described hereinbelow. In the region of the border 3, adjacent to the periphery 4, a continuous thread 5 is sewn in or stitched in over virtually the entire circumference. The two free end sections of said thread project radially outwards.

In a second method step, hair strands 7 or hair tufts, i.e. multiple strands, are stitched in loop form into that region of the base 2 which is bounded by the contour 1 of FIG. 1. In this case, the strands or tufts are first of all sewn onto the base 2 within the contour 1, and they are then drawn radially outwards and sewn onto the base 2 outside the contour 1, whereupon they are drawn into the region within the contour 1 again and there sewn onto the base 2 again. In this manner, all the hair strands or hair tufts 7 are stitched onto the base 2 one after the other.

The loops of the hair strands or hair tufts 7 may all be of the same length or of different lengths. Since, as mentioned below, the loop-form hair strands or hair tufts 7 are cut to length once the hairpiece has been slipped onto the doll's head, and possibly adhesively bonded thereon, the length of these hair strands or hair tufts has to be greater than the length of hair desired. If a "mop of hair" is envisaged, the hair strands or hair tufts, which may possibly not be cut, will be stitched with an appropriate length.

The strands or hair tufts 7 are also expediently stitched using a stitching machine. As the material for the hair strands, use may advantageously be made of polyamide or of some other polymer which may be dyed as required. The strands or tufts may be smooth or textured.

In a further process step, the region which is bounded by the periphery 4 and has the hair strands or hair tufts 7 stitched within the contour 1 is removed from the base 2 which encloses the periphery 4. For this purpose, for example, lateral strips 9 are first of all cut or punched out of the base 2, these strips extending as far as the periphery 4. Thereafter, the base 2 is folded over along the resulting, strip-like cutouts. This makes it possible for the stitched region, together with the border 3, to be completely cut or punched out of the base 2 along the periphery 4, for which purpose, for example, the following procedure may be followed:

That part of the base 2 which is located outside the actual stitched region is separated off by being cut out or punched out along semicircular lines 10. Thereafter, cutting or stamping operations may be carried out along the periphery 4 between the remaining base 2 and the stitched hair strands or hair tufts 7, this having the advantage that the ends of the loops remain anchored on the semicircle surfaces and thus cannot move apart from one another. It is only right at the end that the ends of the loops are separated from the rest of the base 2. The abovementioned cutting-out or punching-out operation advantageously takes place mechanically directly before the hairpiece is attached to the doll's head.

The operation of cutting or punching the stitched hairpiece out of the base 2 is simpler if the sections of the periphery 4 outside the strip 9 have been stitched round, and pierced, in the manner of the buttonhole, as is explained above and illustrated in FIG. 1. All that is really then necessary is for the lateral strips 9 to be cut or punched out.

Since a stitching machine normally has a large number of needles, a similarly large number of stitching operations can be carried out at the same time, this keeping the production costs very low.

In addition to the simple production operations which can be easily adapted to the respective requirements as regards shape and appearance of the hairpiece, the method of the invention has the advantage of being able to achieve a thick covering of hair without any bald patches.

Figure 3:
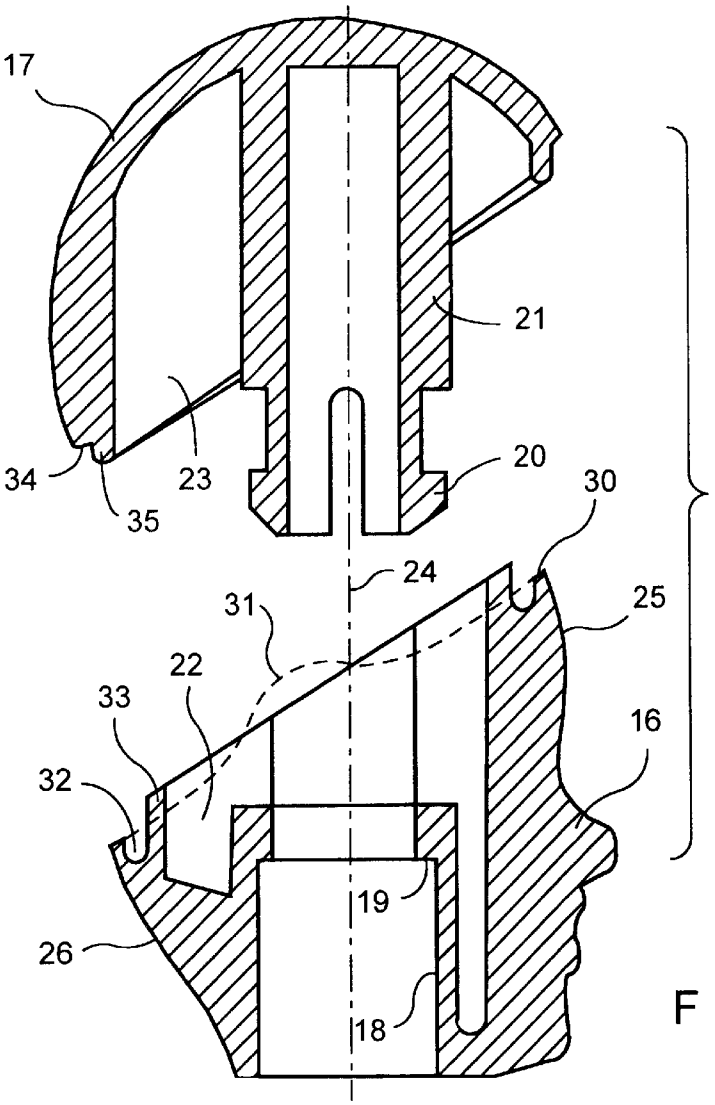
FIG. 3 shows a section along line A—A in FIG. 2.
Figure 2:
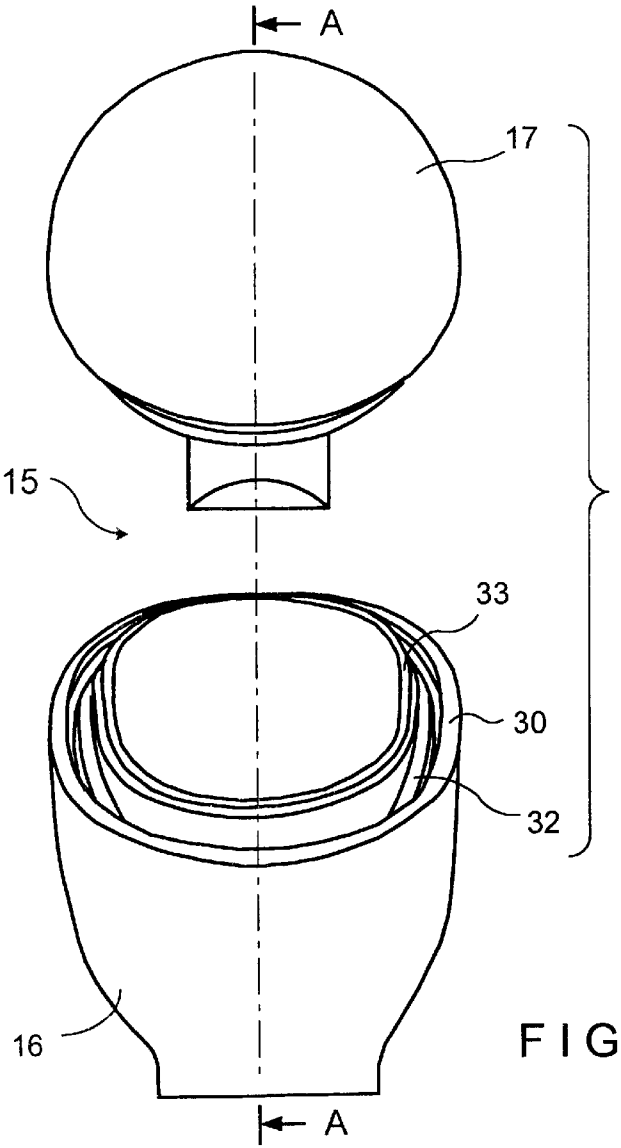
FIG. 2 shows a rear view of a doll's head before assembly.

The doll's head 15 is illustrated in FIGS. 2 and 3. It comprises a bottom part 16 and a top part 17, the latter forming the skull. Both parts 16, 17 are preferably made of plastic, e.g. polystyrene. The bottom part 16 has a stepped through-passage bore 18. In the assembled state, resilient hooks 20 of a stub 21 of the top part 17 are snapped in behind the step 19 of the bore 18. The bottom part 16 and the top part 17 each have a hollowed section 22, 23. These hollowed sections are cut off obliquely with respect to the axis 24 of the bore 18 such that the bottom part 16 is at a higher level in the region of the forehead 25 than in the region of the neck 26.

In the exemplary embodiment illustrated, the top, outer border 30 of the bottom part 16 is planar. However, it may be better from an aesthetic point of view for this border to be curved slightly, which is indicated by the dashed line 31 in FIG. 3.

A groove 32 runs within the border 30 of the bottom part 16. This groove is adjoined by a protrusion 33 projecting beyond the surface of the border 30. In the assembled state, a rib 35 which runs all the way round and projects beyond the border surface 34 of the top part 17, the said border surface being complementary to the border 30, engages in the groove 32.

Figure 4:
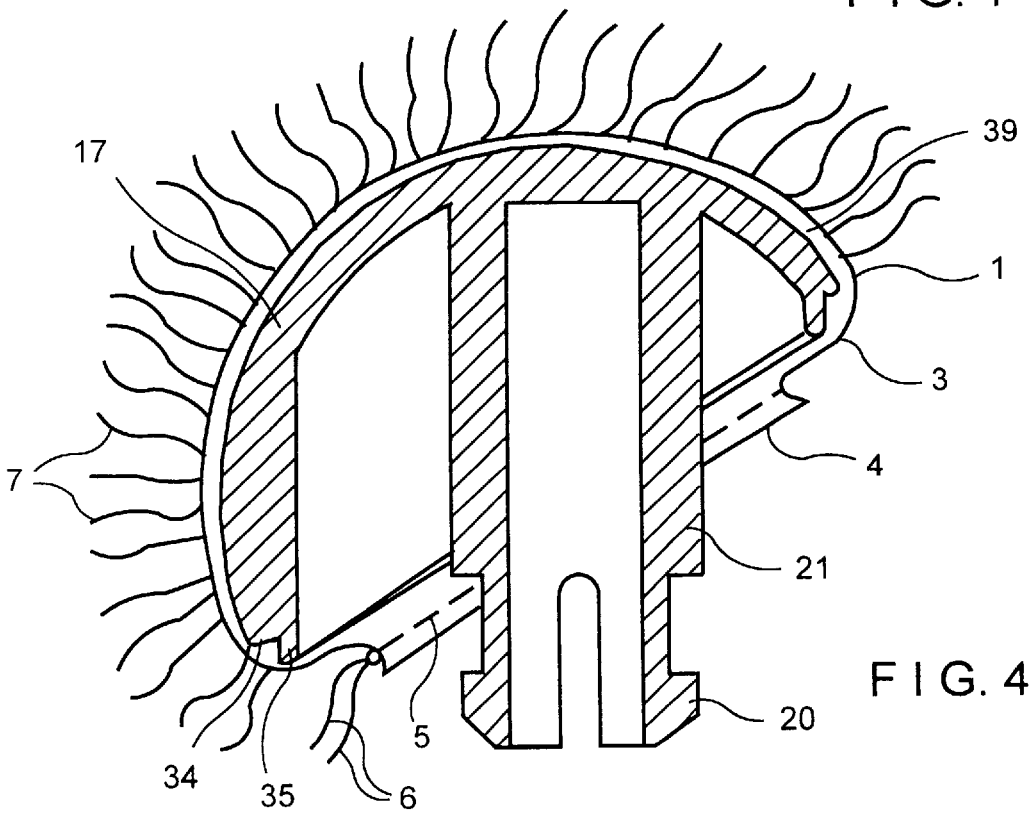
FIG. 4 shows a section, corresponding to FIG. 3, through the top part of the doll's head with the hairpiece attached.

Once the hairpiece has been cut out along the line 10 and the periphery 4, the stitched region within the contour 1 is attached to the outer surface of the top part 17 and possibly adhesively bonded onto the outer surface 39. The two end sections 6 of the thread 5 are then drawn together and knotted with one another (FIG. 4). The contour 1 then runs approximately along the periphery of the border surface 34. Finally, the top part 17 is plugged onto the bottom part 16. In this case, the border 3 is clamped in between the groove 32 and the rib 35 and between the border 30 and the border surface 34. The hairpiece is thus fastened securely on the doll's head 15. If appropriate, it is also possible for the adhesive bonding to be dispensed with. The hair strands or hair tufts 7 of the hairpiece may then be cut to length and combed as required.

As a departure from the exemplary embodiment illustrated, it is also possible for the thread 5 to be omitted and a downwardly projecting, tubular extension to be integrally formed on the top part 17 or for the stub 21 to be lengthed correspondingly. In this case, the border 3 is either tied to this extension or stub 21 using a tie or clamped thereon using a metal or plastic clamp.

What is claimed is:

1. Method of producing a hairpiece which can be fastened on a body part of a toy figure wherein hair strands or hair tufts (7) are stitched in a loop form on a flat, flexible base (2) alternatingly in a first region bounded by a desired hairpiece contour (1) and a second region outside this contour (1), and wherein the first region together with a border (3) which surrounds the hairpiece contour (1), is then removed from the base(2) the second region being outside said first region and said border wherein said loops are released from said second region to form loose hair strands.

2. Method according to claim 1, wherein the flexible base (2), comprises a woven or knitted material and/or a material which is plastically deformable under the action of heat.

3. Method according to claim 1, wherein as the hair strands or hair tufts (7), use is made of synthetic filaments.

4. Method according to claim 1, wherein hair strands or hair tufts (7) of different colors and/or loop lengths are stitched on the base (2).

5. Method according to claim 1, wherein the stitched hair strands or hair tufts (7) are cut to length once the hairpiece has been fastened on a toy figure.

6. Method according to claim 1, wherein the base (2) has elasticity of elongation in at least one direction.

7. Method according to claim 6, wherein adjacent to an inside of a periphery (4) of the border (3), a thread (5) is sewn in or stitched in over the majority of a circumferential length of the border, said thread including end sections protecting outwardly beyond the border.

* * * * *